United States Patent [19]

Bushnell et al.

[11] Patent Number: 4,913,475

[45] Date of Patent: Apr. 3, 1990

[54] SECURITY LOCK MECHANISM

[75] Inventors: Raymond B. Bushnell, Lodi; Larry W. Green, San Francisco, both of Calif.

[73] Assignee: Phelps-Tointon, Inc., San Antonio, Tex.

[21] Appl. No.: 182,963

[22] Filed: Apr. 18, 1988

[51] Int. Cl.[4] ..... E05B 47/00

[52] U.S. Cl. ..... 292/144; 292/DIG. 62; 292/DIG. 49

[58] Field of Search ..... 292/74, 140, 144, 165, 292/166, 168, 173, DIG. 44, DIG. 49, DIG.62

[56] References Cited

U.S. PATENT DOCUMENTS

| | | | |
|---|---|---|---|
| 241,998 | 5/1881 | King | 292/140 |
| 611,790 | 10/1898 | Miltier | 292/166 |
| 1,701,790 | 2/1929 | Morin, Jr. | 292/DIG. 62 X |
| 2,763,888 | 9/1956 | Billeter | 16/59 |
| 3,646,612 | 2/1972 | Anderson | 292/DIG. 62 X |
| 3,893,723 | 7/1975 | Boule | 292/140 |
| 4,691,542 | 9/1987 | Young | 292/140 X |

FOREIGN PATENT DOCUMENTS

| | | | |
|---|---|---|---|
| 599110 | 3/1948 | United Kingdom | 292/140 |

*Primary Examiner*—Richard E. Moore

*Attorney, Agent, or Firm*—Gunn, Lee & Miller

[57] ABSTRACT

Multiple embodiments of a security lock mechanism being adapted for both deadlocked and slam-lock operation are disclosed with different combinations of features including a housing, a movable locking bolt, a rotatable cam having a pin engaged with a slot in the bolt and a centering device such as a remote drive unit or double-acting spring mechanism coupled with the rotatable cam by a lost motion coupling for facilitating slam-lock and deadlocked operation of the security lock mechanism. With the remote drive unit being a pneumatically operated cylinder and piston, the piston is preferably of split construction to facilitate overriding operation of the remote drive unit, for example, by a key.

41 Claims, ~~7~~ 6 Drawing Sheets

SECURITY LOCK MECHANISM

FIELD OF THE INVENTION

The present invention relates to a security lock mechanism of a type employed in custodial systems and for regulating access to secured areas and more particularly to a security lock mechanism adapted for both deadlocked and slam-lock operation.

BACKGROUND OF THE INVENTION

Generally indicated above, the present invention is particularly directed toward security lock mechanisms of a type employed in custodial systems such as penitentiaries and for regulating access to secured areas such as military or industrial installations and other buildings where closely regulated access may be desirable, for example, hotels, etc.

In such applications, it is of course particularly important that the security lock mechanism be reliable and of relatively simple mechanical construction commensurate with the requirements of reliability as noted above and long-term operation.

The security lock mechanism of the present invention is also of a conventional type adapted for both deadlocked and slam-lock operation. Accordingly, it is initially necessary that the security lock mechanism be operable in a deadlocked position where the mechanism remains engaged until properly released, for example, by a remote control unit or by overriding means such as a key or electromechanical device functioning in response to a coded access card or the like.

After being opened by any of the means referred to above, it is then desirable that the security lock mechanism be of a type adapted for operation in a slam-lock mode. In such a mode, a locking bolt or the like is normally positioned in an extended position regulated by fettering means such as a double-acting spring so that as a door is slammed shut, the locking bolt will initially retract upon closing engagement of the door and then immediately extend in order to retain the door in closed engagement.

Obviously, the lock mechanism experiences substantial shock during slam-lock operation and it is particularly important to adapt the lock mechanism for reliable operation over extended periods with minimum failure or wear.

Numerous prior art lock mechanisms, adapted for operation in the manner generally referred to above, have been made available in substantial variety. For example, one such lock system is disclosed in U.S. Pat. No. 4,691,948 issued Sept. 8, 1987 to Austin, Jr., et al. That patent disclosed a fail-secure lock system using normally pneumatically actuated locking bolts which can be manually operated, for example, in the event of a power or air failure.

Many other examples of such lock systems have been made available and may be operable by cam mechanisms where a rotatable cam is coupled with a locking bolt, for example, by means of a rack and pinion coupling or other direct interconnection.

Generally, these prior art lock systems have been found to be satisfactory for their purposes. However, there has been found to remain a need for improved security lock mechanisms for use in applications such as those referred to above. In particular, there has been found to remain a need for improved security lock mechanisms capable of reliable operation over extended periods of time. It has further been found that such advantages can be best achieved where minimum mechanical shock is introduced or applied within the lock mechanism.

SUMMARY OF THE INVENTION

It is therefore an object of the present invention to provide an improved security lock mechanism of the type generally referred to above and adapted for both deadlocked and slam-lock operations while providing for reliable operation over extended periods of time. It is a further related object of the invention to provide such a security lock mechanism which is of relatively simple but reliable construction in order to provide the necessary reliability and long-term operation while being of relatively simple mechanical construction in order to minimize the need for maintenance and the like.

It is a further object of the invention to provide a security lock mechanism which includes a lost motion coupling for facilitating slam-lock and deadlocked operation of the security lock mechanism. As noted above, slam-lock operation normally results in substantial stress and shock being introduced into the lock mechanism. The lost motion coupling provided by the present invention minimizes or eliminates such conditions and thereby facilitates both slam-lock and deadlocked operation of the lock mechanism.

The lost motion coupling is preferably provided between a rotatable cam means for operating the locking bolt and a centering means which may comprise either a remote drive unit or a double-acting spring. The lost motion coupling facilitates operation of the lock by permitting the rotatable cam to be in its slam-lock and deadlocked positions at opposite operating limits for the lost motion coupling.

In one or more embodiments of the invention as disclosed below, the lost motion coupling is preferably embodied as a slot and pin interconnection, the length of the slot being generally equal to angular rotation of the cam between its deadlocked and slam-lock positions.

It is a further object of the invention to provide such a security lock mechanism wherein a longitudinally movable locking bolt forms a slot arranged perpendicularly to an axis of rotation for a rotatable cam, a pin secured to the cam extending into the slot. Preferably, the length and arrangement of the slot on the locking bolts are selected to permit the rotatable cam means to be rotated between its deadlocked and slam-lock positions with the locking bolt remaining substantially fully extended from the housing, the slot and pin also interacting to retract the locking bolt into the housing when the cam means is rotated to an open position. Even more preferably, the arrangement and dimensions of the slot and pin are selected so that the pin is in an over-center position relative to the axis of the rotatable cam means and the longitudinal axis of the locking bolt when the rotatable cam means is in a deadlocked position. This arrangement positively prevents retraction of the locking bolt.

It is a further related object of the invention to provide detent means for maintaining the rotatable cam means in the deadlocked position in order to prevent accidental or unauthorized retraction of the locking bolt.

It is yet a further object of the invention to provide a security lock mechanism having an interconnected locking bolt and rotatable cam means as disclosed above while being operable by other means such as a key or an electromechanical device responsive to a coded card or the like. Here again, the slot and pin interconnection between the longitudinally movable locking bolt and the rotatable cam provide a simple but reliable mechanical interconnection facilitating operation of the lock mechanism between a deadlocked position and an open position.

A security lock mechanism of the type referred to immediately above may be employed in combination with centering means such as a double-acting spring means or the like to further facilitate slam-lock operation even without the lost motion coupling described above. However, the lost motion coupling is preferably employed between the rotatable cam and the centering device in order to minimize mechanical shock within the lock mechanism as noted above.

Additional objects and advantages of the invention are made apparent in the following description having reference to the accompanying drawings.

DESCRIPTION OF THE PREFERRED EMBODIMENTS

Figure 1:
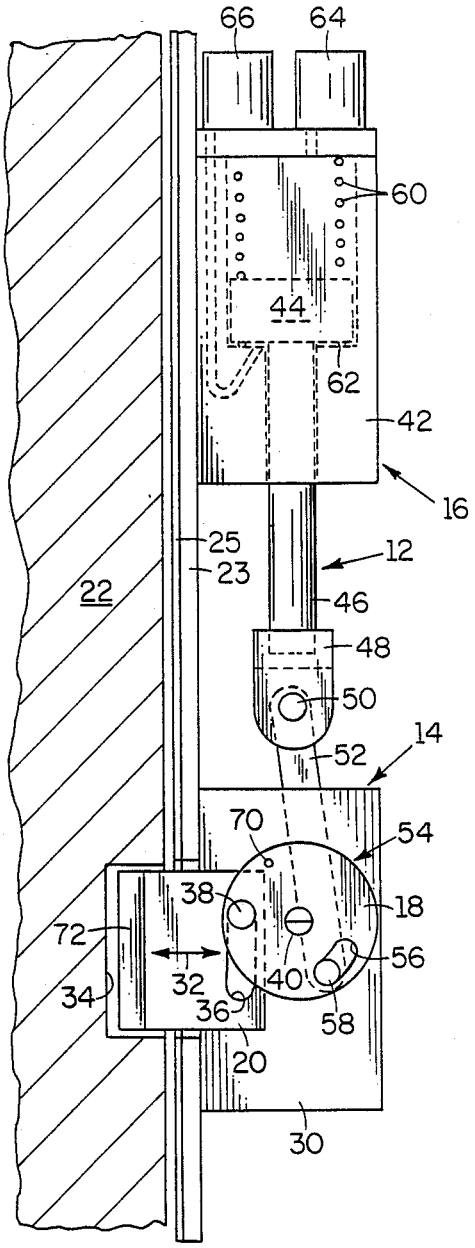
FIG. 1 is a diagrammatic and partially schematic side view of a security lock mechanism constructed according to the present invention and illustrated in a deadlocked position or mode of operation.

Referring now to the drawings, a number of embodiments of a security lock mechanism constructed according to the present invention are illustrated by the various figures. A first embodiment of the security lock mechanism is generally indicated at 12 in FIGS. 1-6. The security lock mechanism 12 of those figures includes a mechanical lock assembly 14 operated by a remote drive unit 16 and including a rotatable cam 18 and locking bolt 20 as described in greater detail below for regulating engagement between a door and frame member respectively indicated in part at 22 and 24. The lock assembly 14 and remote drive unit 16 are secured to a lock mounting plate 23.

Figure 7:
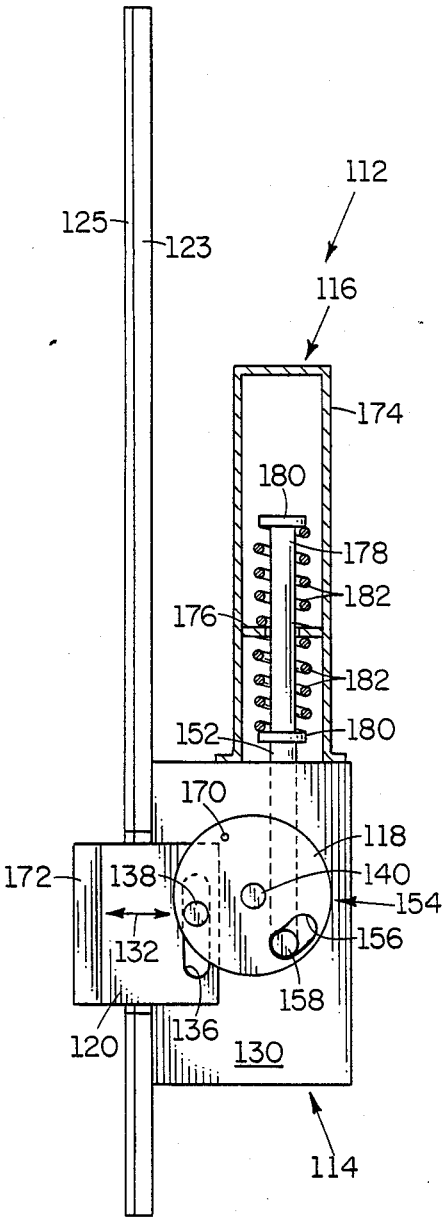
FIG. 7 is a diagrammatic illustration of another embodiment of the invention where a similar security lock mechanism is connected with a double-acting spring mechanism through a lost motion coupling.

Another embodiment of a security lock mechanism constructed according to the present invention is generally indicated at 112 in FIG. 7 and includes a similar mechanical locking assembly 114 operated by a centering device or double-acting spring assembly 116 rather than the remote drive unit 16 of FIGS. 1-6.

Figure 8:
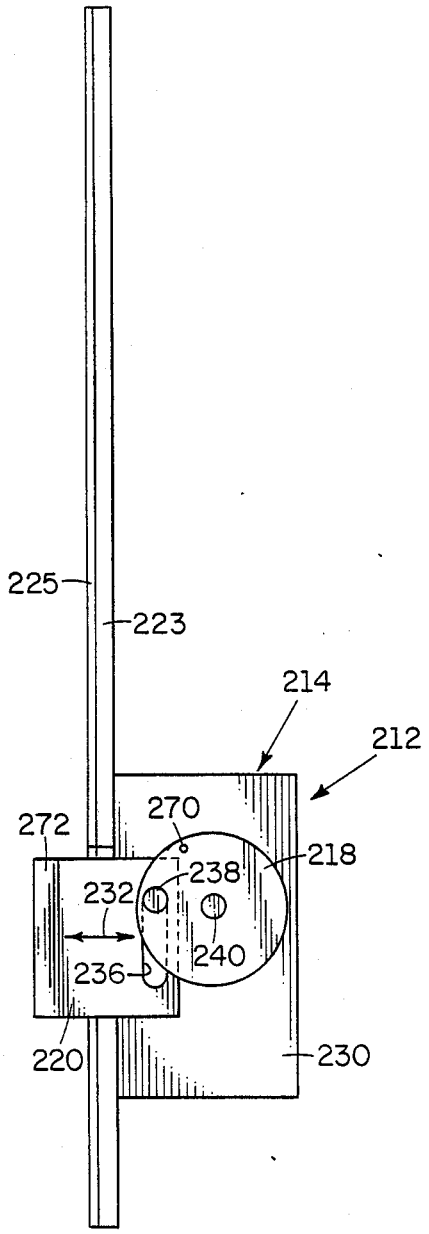
FIG. 8 is a diagrammatic side view of yet another embodiment of the present invention comprising a security lock mechanism directly operable by a key and without the lost motion coupling employed in the embodiments of FIGS. 1-7.
Figure 9:
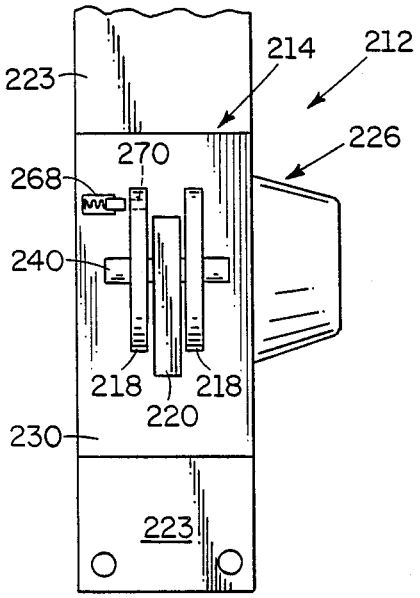
FIG. 9 is a view taken from the left side of FIG. 8.

Yet another embodiment of a security lock mechanism constructed according to the present invention is generally indicated at 212 in FIGS. 8 and 9. The security lock mechanism 212 includes a similar mechanical lock assembly 214 which is operated only by a key assembly 226 and accordingly does not include a centering device such as the remote drive unit 16 of FIGS. 1-6 or the double-acting spring assembly 116 of FIG. 7.

Figure 10:
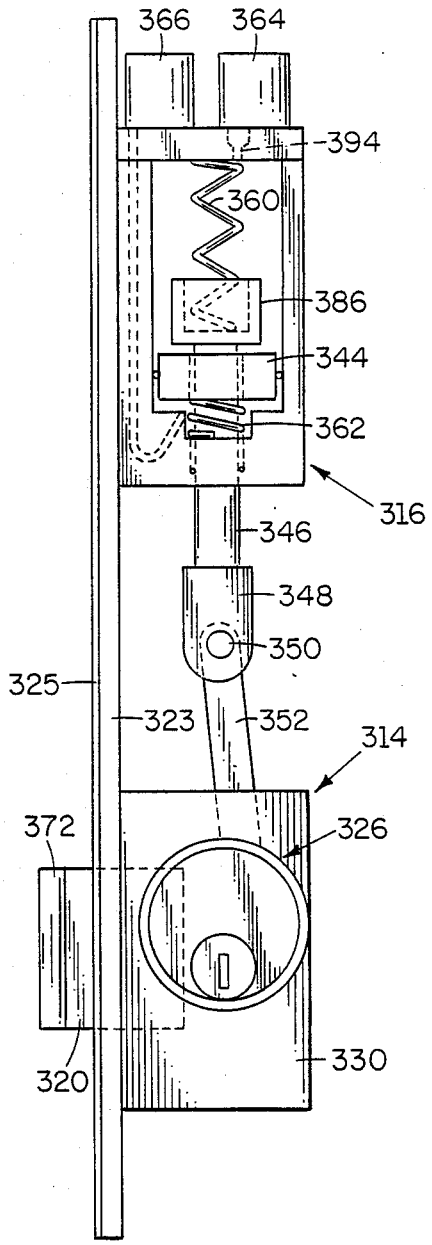
FIG. 10 diagrammatically illustrates yet another embodiment generally similar to that of FIGS. 1-6, the remote drive unit being a pneumatic cylinder including a split piston for further facilitating overriding operation by a key.
Figure 11:
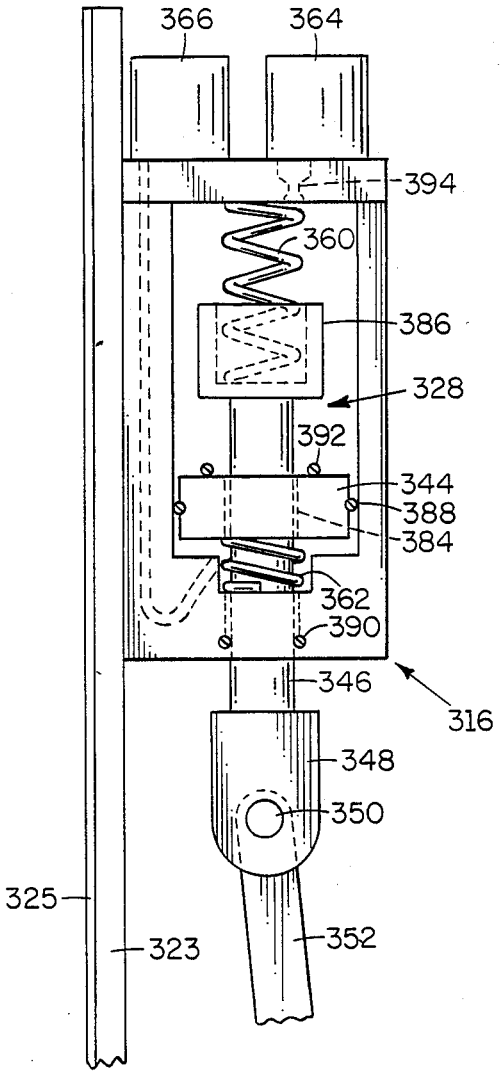
FIG. 11 is an enlarged fragmentary view of the split piston of FIG. 10.

Still another embodiment of a security lock mechanism constructed according to the present invention is generally indicated at 312 in FIGS. 10-11. The security lock mechanism 312 also includes a similar mechanical lock assembly 314 operated by a remote drive unit 316. The remote drive unit 316 is preferably pneumatically operated as described in greater detail below and includes a split piston assembly 328 for facilitating operation of the lock mechanism 312 by a key assembly 326 to override the remote drive unit 316.

Detailed descriptions of the various security lock mechanisms illustrated in FIGS. 1-11, as well as their methods of operation, are described in greater detail below. However, it is to be noted that all of the embodiments include a similar rotatable cam, as indicated at 18 in FIGS. 1-6 for operating a locking bolt, indicated at 20. The embodiments of FIGS. 1-6, 7 and 10-11 are primarily operated by a centering device such as the remote drive unit 16 of FIGS. 1-6, the double-acting spring assembly 116 of FIG. 7 or the remote drive unit 316 of FIG. 10. Each of those embodiments is also preferably adapted for overriding operation by a key assembly such as that indicated at 326 in FIGS. 10-11. By contrast, the security lock mechanism 212 of FIGS. 8-9 does not include a centering device and is operable only by the key assembly indicated at 226.

Figure 2:
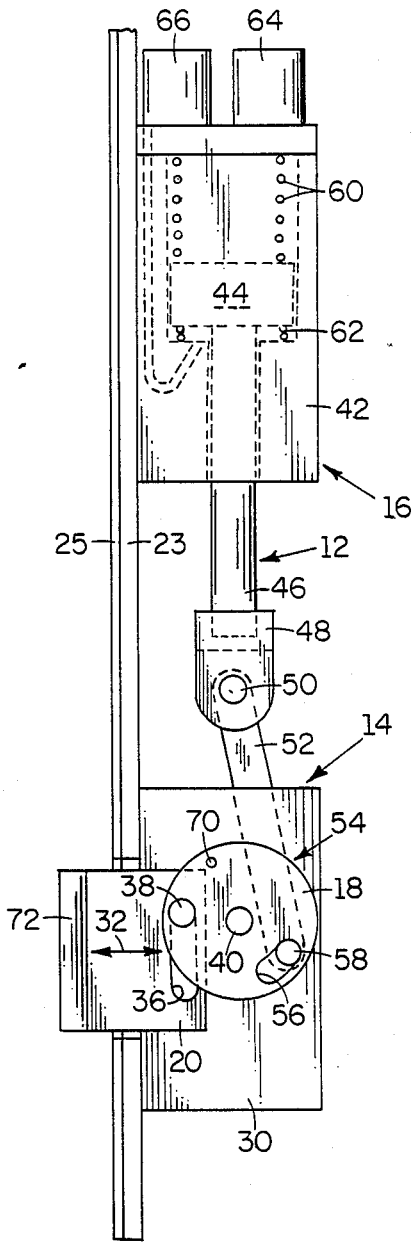
FIG. 2 is a view similar to FIG. 1 but with a remote drive means being allowed to return to a spring-centered position by means of a lost motion coupled.
Figure 3:
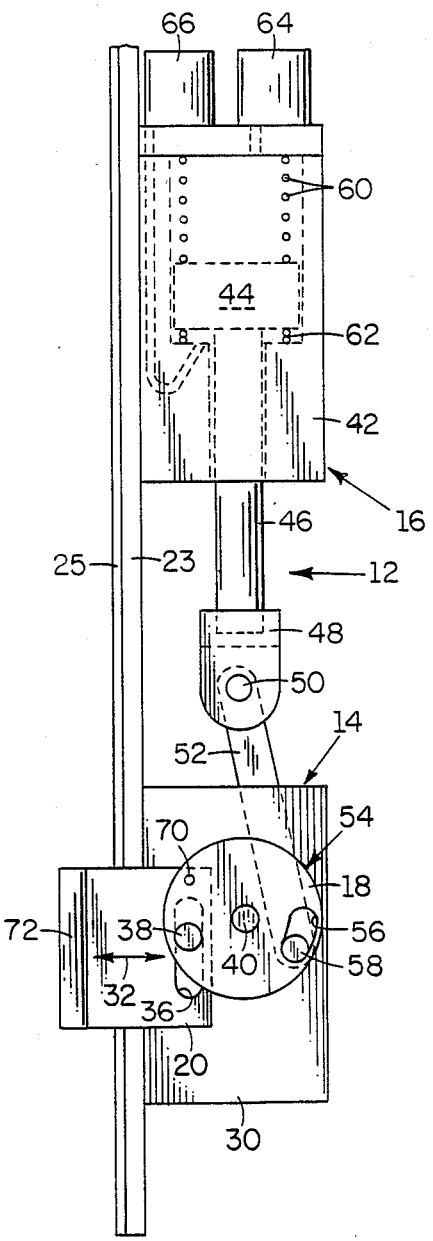
FIG. 3 is a further view similar to FIG. 1 but with the components of the security lock mechanism in a slam-lock position or mode of operation.
Figure 4:
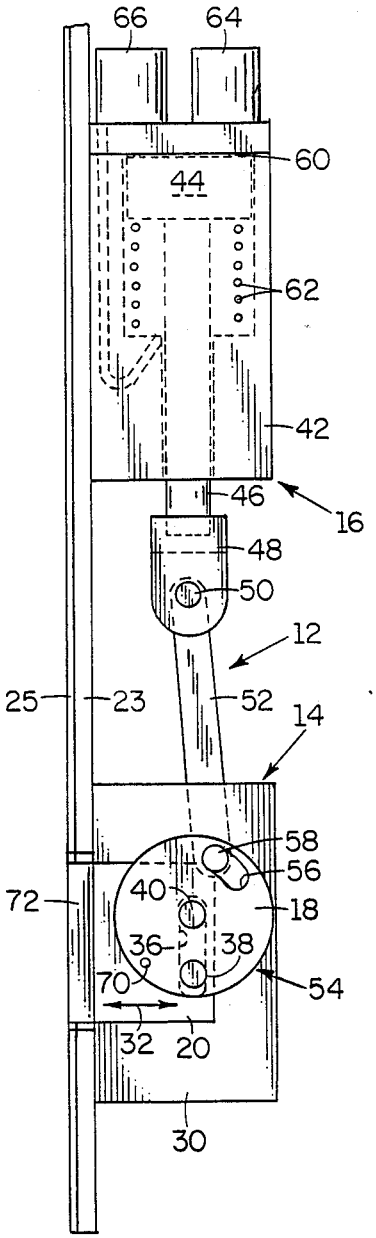
FIG. 4 is yet another view similar to FIG. 1 but with the components of the security lock mechanism in an open position or mode of operation.
Figure 5:
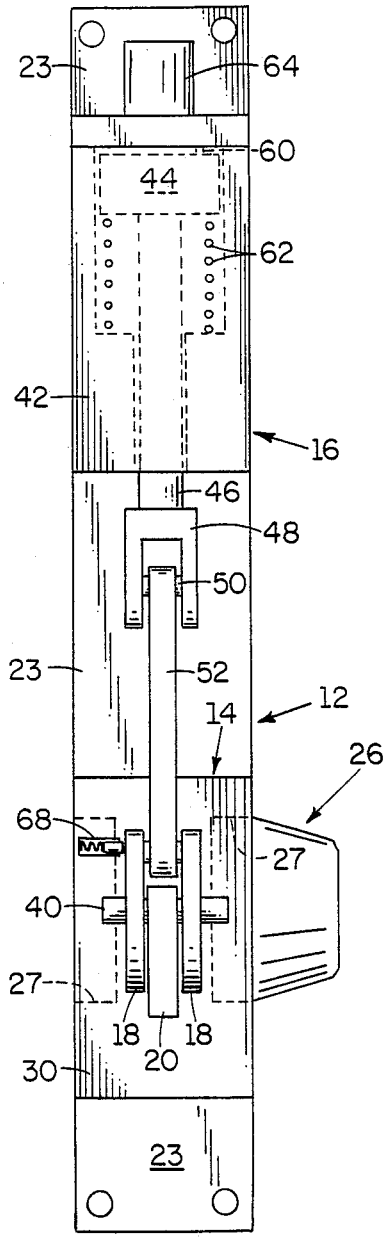
FIG. 5 is a diagrammatic view taken from the right side of FIG. 4 to better illustrate the construction and configuration of the security lock mechanism illustrated in FIGS. 1-4.

Referring now in particular to FIGS. 1-5, various operating positions for the security lock mechanism 12 are respectively indicated by FIGS. 1-4 with FIG. 5 illustrating an end view of the lock mechanism as seen from the right side of FIG. 4. In FIG. 1, the security lock mechanism 12 is illustrated in a deadlocked position for assuring continued engagement between the door 22 and frame 24. FIG. 2 represents the security lock mechanism 12 in generally the same operating position as FIG. 1 but with the remote drive unit 16 returned to a spring-centered position. FIG. 3 illustrates the security lock mechanism 12 in a slam-lock position, as described in greater detail below, and FIG. 4 illustrates the security lock mechanism 12 in an open position.

These operating positions or modes are also contemplated for the other lock embodiments, particularly those illustrated in FIG. 7 and in FIGS. 10-11. The embodiment of FIGS. 8-9 illustrates that certain components of the security lock mechanism, as another embodiment of the present invention, may also be operated without the slam-lock feature.

Before describing the specific components of the lock mechanism 12, it is important to understand normal operating sequences for the lock mechanism 12. In particular, after the mechanism 12 is positioned in the deadlocked condition illustrated in FIG. 1 by the remote drive unit 16, deactuation of the controls or solenoids (described below) allows the remote drive unit 16 to return to a spring-centered position illustrated in both FIGS. 2 and 3. FIG. 2 illustrates that the mechanical lock assembly 14 can remain in its deadlocked position as the remote drive unit 16 returns to its spring-centered condition. At the same time, because of a lost motion connection (described in greater detail below) and referring particularly to FIG. 3, the mechanical lock assembly 14 can also be in its slam-lock position or mode with the remote drive unit 16 in a spring-centered condition.

In normal operation, the security lock mechanism 12 is shifted from the deadlocked position of FIG. 1 or FIG. 2 to the open position of FIG. 4 in order to retract the locking bolt 20 and to permit the door 22 to be opened away from the frame 24. The door 22 may either slide or swing relative to the frame 24 while still being regulated by the same security lock mechanism 12.

With the lock mechanism 12 being in the open position illustrated in FIG. 4, it is then common practice to shift to the slam-lock position illustrated in FIG. 3. When the door is closed with the lock in this position, spring-centering for the locking bolt 20 permits it to be retracted by initial engagement with the door 22 and then again extended in order to secure the door 22 relative to the frame 24. The lock mechanism 12 may then again be returned to the deadlocked position or mode illustrated in FIG. 1. As was also noted above, the lock mechanism 12 may be shifted between these operating positions or modes either by the remote drive unit 16 or by the key assembly 26.

Referring particularly to FIG. 1, the mechanical lock assembly 14 includes a housing 30 with the locking bolt 20 being movable in the housing 30 along its longitudinal axis generally indicated at 32. The locking bolt may thus be extended in the position illustrated in FIG. 1 for engagement with an opening 34 or strike plate (not shown) in the door 22 in order to secure the door 22 relative to the frame 24. The locking bolt 20 may also be retracted as illustrated in FIG. 4 in order to release the door 22 from the frame 24.

Movement of the locking bolt 20 along its longitudinal axis 32 is regulated by the rotatable cam 18 which is coupled with the locking bolt 20 by means of an elongated slot 36 formed in the locking bolt 20 and a bolt pin 38 secured to the rotatable cam 18 for register with the slot 36.

The cam 18 has an axis of rotation defined by the cam pin 40 upon which the rotatable cam 18 is mounted. In positioning these components, the elongated slot 36 is perpendicular both to the longitudinal axis 32 of the locking bolt 20 as well as the axis of rotation for the cam 18 as defined by the cam pin 40.

The remote drive unit 16 preferably includes a cylinder 42 and piston 44 adapted for pneumatic operation as described in greater detail below, particularly in the embodiment of FIGS. 10–11. However, it is to be understood that the remote drive unit 16 could also be hydraulically operated or could, for example, be of electromechanical configuration and operation. However, neither the hydraulic configuration nor the electromechanical configuration is illustrated.

The piston 44 is conventionally arranged within the cylinder 42 so that its rod 46 extends out of the cylinder and downwardly for engagement through a coupler 48 and pivot pin 50 with a drive link 52.

A lower end of the drive link 52 is coupled with the rotatable cam by means of a lost motion coupling 54. The lost motion coupling 54 preferably includes a circumferentially extending slot 56 formed in the rotatable cam 18 and a link pin 58 secured to the lower end of the drive link 52 for register with the slot 56.

Referring again to the remote drive unit 16, centering springs 60 and 62 arranged on opposite sides of the piston 44 tend to center the piston 44 in the slam-lock position illustrated in FIG. 3. However, as noted above and as will be described in greater detail below, the lost motion coupling 54 permits the piston 44 to be in its spring-centered or relaxed position with the mechanical lock assembly 14 either in the slam-lock configuration of FIG. 3 or in the deadlocked configuration illustrated in FIG. 2.

Operation of the remote drive unit 16 is normally regulated by opposed first and second solenoids 64 and 66 respectively in communication with the upper and lower end of the cylinder 42. Thus, the first solenoid 64 can be operated to power the piston 44 downwardly against the lower centering spring 62 in order to urge the lock assembly into the deadlocked position or mode of FIG. 1. As noted above, if the solenoid 64 is then deactuated, the centering springs 60 and 62 will tend to return the piston 44 to the position illustrated in FIGS. 2 and 3.

Before describing the mode of operation for the embodiment of FIGS. 1–6, additional features of the mechanical lock assembly 14 are described immediately below. Referring initially to FIG. 1, operation of the first solenoid 64 causes extension of the piston 44 so that the rotatable cam 18 is positioned as shown by the link pin 58 with the bolt pin 38 at the upper end of the slot 36 in an over-center condition relative to the configuration and arrangement of the locking bolt 20 and cam 18. In the deadlocked position of FIG. 1, the bolt pin 38 is just above the axis of the cam pin 40, preferably about 6 degrees, in order to assure that the over-center condition is maintained.

The rotatable cam 18 is held in its deadlocked position by a spring-loaded detent pin 68 arranged in the housing 30 (see FIG. 5) and engaging a detent opening 70 in the rotatable cam 18. The detent pin 68 holds the rotatable cam 18 in the deadlocked position of FIG. 1 at least until substantial force is applied either by the remote drive unit 16 or, for example, by overriding operation of the key assembly 26 (also see FIG. 5).

Referring particularly to FIG. 5, recesses 27 are provided on both sides of the housing 30 so that a key assembly 26 can be mounted on either or both sides as desired.

When the second solenoid 66 is actuated, it retracts the piston 44 upwardly into the cylinder 42 causing the drive link 52 and link pin 58 to rotate the cam 18 into the open position illustrated in FIG. 4 with the locking bolt fully retracted into the housing 30. The door 22 can of course be opened with the lock mechanism in that position or mode.

After the lock mechanism has been moved to the open position or mode illustrated in FIG. 4, it is normally returned to its slam-lock position or mode of FIG. 3 either by operation of the first solenoid 64 or simply by deactuation of the second solenoid 66, whereupon the piston 44 is centered by the springs 60 and 62.

When the lock assembly is shifted from the deadlocked position of FIG. 1 to the open position of FIG. 4, the bolt pin 38 moves downwardly along the length of the slot 36 in order to retract the locking bolt 20. Then, as the lock assembly is shifted to the slam-lock position of FIG. 3, the bolt pin 38 assumes a position substantially under-center relative to the axis of rotation for the cam 18.

Preferably, the slam-lock position for the bolt pin 38 is about 17 degrees under-center or about 23 degrees of angular rotation from the deadlocked position illustrated in FIGS. 1 and 2. The slot 56 in the lost motion coupling 54 is preferably formed with substantially the same length as the angular displacement for the bolt pin 38 between the deadlocked position of FIG. 1 and the slam-lock position of FIG. 3. In other words, the total length of the lost motion slot 56 is also approximately 23 degrees in length. As noted above, this feature permits the remote drive unit 16 to be in its spring-centered position illustrated in both FIGS. 2 and 3 with the rotatable cam 18 in either the deadlocked position of FIGS. 1 and 2 or the slam-lock position of FIG. 3. Thus, with the remote drive unit 16 in its spring-centered position, substantially no mechanical force is applied to the mechanical lock assembly 14 in either of those operating conditions in order to assure reliable operation and minimum wear.

The locking bolt 20 is also formed with a bevel 72 for engagement with the strike plate of the door to facilitate slam-lock operation as described above.

Figure 6:
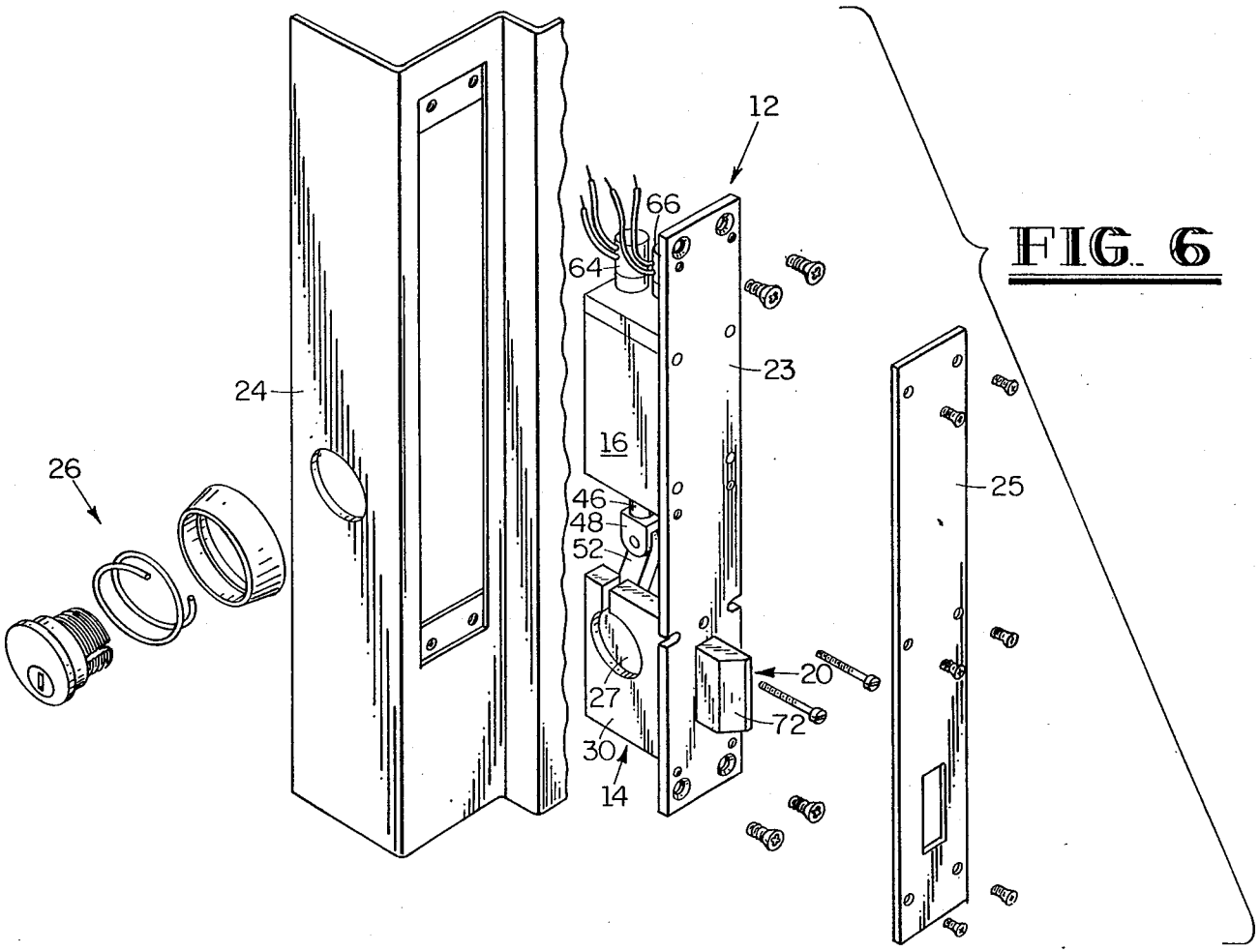
FIG. 6 is an exploded pictorial representation of the lock mechanism of FIGS. 1-5.

A cover plate for the lock mechanism is indicated at 25 in FIG. 6.

The mechanical lock assembly 14 of FIGS. 1–6 can also be operated by the key assembly 26 illustrated in FIG. 5 and 6. However, it may be necessary for the key assembly to override back pressure from the remote drive unit. The embodiment of FIGS. 9 and 10 facilitate overriding operation of the lock mechanism by the key assembly, as described in greater detail below in order to avoid or minimize the effect of such back pressure.

Referring now to FIG. 7, the security lock mechanism 112 includes a mechanical lock assembly 114 with substantially the same features as in the mechanical lock assembly 14 of FIGS. 1–6. Accordingly, components in the mechanical lock assembly 114 are indicated by similar numerical labels in the description of FIGS. 1–6 and preceded by the digit "1".

In the embodiment of FIG. 7, the remote drive unit 16 is replaced by a centering device in the form of the double-acting spring assembly 116. The double-acting spring assembly 116 includes a spring housing 174 having a centering disk 176 positioned about mid-way within the housing 174. A pin 178, having spring keepers 180 at its opposite ends, is secured to the drive link 152 and extends through an opening in the disk 176. Centering springs 182 interact respectively between the spring keepers 180 and the disc 176 for normally maintaining the rotatable cam 18 in the slam-lock position illustrated in FIG. 7.

Thus, the security lock mechanism 112 of FIG. 7 can be operated similarly as the security lock mechanism 12 of FIGS. 1–6. However, the rotatable cam 18 is positioned in one of its deadlocked, slam-lock and open modes by the key assembly illustrated in phantom at 126 rather than by the remote drive unit 16 as described above in connection with FIGS. 1–5.

Referring now to FIGS. 8 and 9, the security lock mechanism 212 again includes a mechanical lock assembly including components similar to those described above in connection with FIGS. 1–6. Elements of the mechanical lock assembly 214 of FIGS. 8–9 are indicated by similar numerical labels in the preceding description of FIGS. 1–6 and preceded by the additional digit "2".

The mechanical lock assembly 214 in the security lock mechanism 212 of FIGS. 8 and 9 does not include a lost motion coupling corresponding to that indicated at 54 in FIGS. 1–6. However, it does include the same combination of an elongated slot 236 and bolt pin 238 so that the locking bolt 220 can be extended when the rotatable cam 218 is in a deadlocked position and retracted when the rotatable cam 218 is in an open position or mode. Those positions of the rotatable cam 218 correspond to the cam positions illustrated respectively by the cam 18 in FIGS. 1 and 4. The mechanical lock assembly 214 also includes a detent opening 270 in the cam 218 for engagement with a detent pin similar to that indicated at 68 in FIG. 5.

Thus, the security lock mechanism 212 of FIGS. 8–9 can be similarly operated between deadlocked and open positions corresponding to the above description for the security lock mechanism 12 with respect to FIGS. 1–6.

It would also be possible to optionally combine a lost motion coupling similar to that discussed at 54 in the embodiment of FIGS. 1–6 with the security lock mechanism 212 of FIGS. 8–9. However, for simplicity and to avoid additional repetitive figures, that variation is not illustrated since it would closely conform to the embodiment 112 of FIG. 7 upon the addition of a centering device such as the double-acting spring assembly 116 of FIG. 7.

Still another embodiment of a security lock mechanism according to the present invention is generally indicated at 312 in FIGS. 10–11. Here again, the security lock mechanism 312 includes a mechanical lock assembly 314 of substantially similar construction as the mechanical lock assembly 14 of FIGS. 1–6. Similar numerical labels are employed in FIGS. 10–11 corresponding to the numerical labels of FIGS. 1–6 and preceded by the digit "3".

Furthermore, the security lock mechanism 312 of FIGS. 10–11 includes a remote drive unit 316 of substantially similar construction as the remote drive unit 16 of FIGS. 1–6. However, at least in the embodiment of FIGS. 10–11, the remote drive unit 316 is pneumatically operated by a compressible fluid or gas in order to permit use of the split piston 328 described in greater detail below. Before describing that feature of the invention, it is noted that internal components of the mechanical lock assembly 314 are not shown other than the overriding key assembly 326 since the internal components are similar to those described above and illustrated in FIGS. 1–6.

The split piston 328 includes a piston 344 corresponding to the piston 44 of FIGS. 1–6 and having similar centering springs 360 and 362. However, the rod 346 extends through a central opening 384 in the piston 344 for connection with a cup or spring keeper 386 arranged for engagement with the upper centering spring 360. The rod 346 and piston 344 are provided with 0-rings 388 and 390 similar to the piston 44 and rod 46 in FIGS. 1–6 (similar 0-rings not being shown in FIGS. 1–6). In addition, the remote drive unit 316 includes an 0-ring or ring seal 392 arranged for axial engagement between the piston 344 and the spring keeper 386.

In order to assure proper operation of the remote drive unit 316, it is also important to limit air pressure introduced into the upper end of the cylinder 342 by the upper solenoid 364. For that purpose, a flow restriction 394 is provided to limit air flow into the upper end of the cylinder 342 from the first solenoid 364.

In operation, the remote drive unit 316 functions in substantially the same manner as the remote drive unit 16 as described above with relation to FIGS. 1–6, at least during normal operation of the mechanical lock assembly 314 by the remote drive unit 316.

The split piston 328, however, facilitates overriding operation of the mechanical lock assembly 314 by the key assembly 326, particularly when back pressure is being applied by the remote drive unit 316. Under such conditions, because of the split piston configuration, it is necessary to operate the key assembly 326 only against the force of the upper centering springs 360 and not against pressure in the upper end of the cylinder 342 acting on the piston 344. For example, when the key rotates the mechanical lock assembly 314 to its open position, resulting clockwise rotation of the cam 318 urges the drive link 352 and rod 346 upwardly with the spring keeper 386 separating from the piston 344. Otherwise, with the remote drive unit 316 operating in the manner described above for the remote drive unit 16 of FIGS. 1–6, the seal 392 assures that the piston 344 and the spring keeper 386 operate as an integral split piston unit within the cylinder 342.

Accordingly, there have been described a number of embodiments of a security lock mechanism constructed and operable in accordance with the present invention. Additional variations and additions besides those specifically described above will be apparent and the scope of the present invention is therefore defined only by the following appended claims.

What is claimed is:

1. A security lock mechanism comprising
a housing,
a locking bolt slidably mounted in the housing for sliding movement to an extended position from a retracted position;
a rotatable cam means operatively coupled with the locking bolt and having first and second relatively rotated positions to permit said bolt to slidingly move to an extended position for deadbolt and slam-lock operation;
a pneumatically powered means, and
a lost motion coupling between the pneumatically powered means and the rotatable cam means for facilitating slam-lock and deadlocked operation of the security lock mechanism.

2. The security lock mechanism of claim 1 wherein the pneumatically powered means is a remote drive means for moving the rotatable cam means to its deadlocked and slam-lock positions and for causing the rotatable cam means to retract the locking bolt to an open position.

3. The security lock mechanism of claim 1 wherein the pneumatically powered means includes a double-acting spring means, the lost motion coupling permitting the rotatable cam means to be normally maintained in either its deadlocked position or slam-lock position by the double-acting spring means.

4. The security lock mechanism of claim 3 further comprising means for rotating the cam means to its deadlocked position, its slam-lock position and an open position with the locking bolt retracted into the housing.

5. The security lock mechanism of claim 3 further comprising detent means for releasably maintaining the cam means in a deadlocked position to secure the locking bolt in extending relation from the housing.

6. The slam-lock mechanism of claim 2 further comprising detent means for releasably maintaining the rotatable cam means in a deadlocked position to secure the locking bolt in extended relation from the housing.

7. The security lock mechanism of claim 1 further comprising detent means for releasably maintaining the rotatable cam means in a deadlocked position to secure the locking bolt in extended relation from the housing.

8. The security lock mechanism of claim 1 wherein the locking bolt is arranged perpendicular to an axis of the rotatable cam means and further comprising a slot formed by the locking bolt and a pin secured to the rotatable cam means and extending into the slot.

9. The security lock mechanism of claim 8 wherein the length and arrangement of the slot on the locking bolt are selected to permit the rotatable cam means to be rotated between deadlocked and slam-lock positions with the locking bolt substantially fully extended from the housing and to interact with the pin for retracting the locking bolt into the housing when the rotatable cam means is rotated to an open position.

10. The security lock mechanism of claim 9 wherein the pin is in an over-center position relative to the axis of the rotatable cam means and the longitudinal axis of the locking bolt when the rotatable cam means is in a deadlocked position to prevent retraction of the locking bolt.

11. The security lock mechanism of claim 10 further comprising detent means for releasably maintaining the rotatable cam means in a deadlocked position to secure the locking bolt in extended relation from the housing.

12. The security lock mechanism of claim 11 wherein the lost motion coupling comprises a slot and pin interconnection between the rotatable cam means and the pneumatically powered means.

13. The security lock mechanism of claim 1 wherein the lost motion coupling comprises a slot and pin interconnection between the rotatable cam means and the pneumatically powered means.

14. The security lock mechanism of claim 13 wherein the slot has a length approximately equal to angular rotation of the rotatable cam means between its slam-lock and deadlocked positions.

15. The security lock mechanism of claim 1 wherein the pneumatically powered means comprises a remote double-acting drive means for moving the rotatable cam means into deadlocked and open positions with the locking bolt respectively extended from and retracted into the housing.

16. The security lock mechanism of claim 15 further comprising double-acting spring means tending to maintain the rotatable cam means in its slam-lock position and deadlocked position at opposite operating limits of the lost motion coupling.

17. The security lock mechanism of claim 16 wherein the double-acting drive means is a cylinder and piston and further ocmprising means for pressurizing opposite ends of the cylinder, the piston being arranged in the cylinder and connected with a link coupled to the rotatable cam means by the lost motion coupling.

18. A security lock mechanism comprising a housing, an elongated locking bolt mounted in the housing for movement along its longitudinal axis and forming a slot extending perpendicularly to the longitudinal axis of the locking bolt, a rotatable cam means having its axis of rotation arranged perpendicularly to both the longitudinal axis and slot of the locking bolt, a pin secured to the rotatable cam means and extending into the slot, means for rotating the rotatable cam means to a deadlocked position with the pin at one end of the slot and in over-center relation to the rotatable cam means with the locking bolt being fully extended and to an open position with the locking bolt being fully retracted, and double acting means coupled with the rotatable cam means tending to maintain the cam means in the slam-lock position.

19. The security lock mechanism of claim 18 further comprising detent means for releasably maintaining the rotatable cam means in a deadlocked position to secure the locking bolt in extended relation from the housing.

20. The security lock mechanism of claim 18 further comprising a lost motion coupling between the double-acting means and the rotatable cam means for facilitating slam-lock and deadlocked operation of the security lock mechanism.

21. The security lock mechanism of claim 20 further comprising detent means for releasably maintaining the rotatable cam means in a deadlocked position to secure the locking bolt in extended relation from the housing.

22. The security lock mechanism of claim 20 wherein the lost motion coupling comprises a slot and pin interconnection between the rotatable cam means and the double-acting means.

23. The security lock mechanism of claim 22 wherein the slot has a length approximately equal to angular rotation of the rotatable cam means between its slam-lock and deadlocked positions.

24. The security lock mechanism of claim 23 wherein the double-acting means tends to maintain the rotatable cam means in its slam-lock position and deadlocked position respectively at opposite limits of the lost motion coupling.

25. A security lock mechanism, comprising a lock housing, a locking bolt, (1) supported in said housing, (2) for extending through a bolt opening in said housing, (3) for extending to a locking position, and (4) for moving through said housing to a retracted position;

guide means for aligning said bolt for linear movement through said opening between said locking and retracted positions;

rotatable cam means mounted adjacent to said bolt;

a locking surface on said cam means for securing said bolt in the locking position when said cam means is in a first position and wherein said cam means has a second position permitting movement of said bolt between positions;

powered means connected to said cam means for moving said cam means between said first and second positions, said powered means (1) providing movement to said cam means on movement between positions in one direction, and (2) providing lost motion movement to said cam means on movement between positions in the opposite direction.

26. The security lock mechanism of claim 25 wherein the powered means is a remote drive means for moving the rotatable cam means to the first and second positions and for causing the rotatable cam means to retract said bolt.

27. The security lock mechanism of claim 25 wherein the powered means is a double-acting spring means.

28. The security lock mechanism of claim 27, wherein said powered means includes a lost motion coupling permitting the rotatable cam means to be continually maintained in either position by the double acting spring means.

29. The security lock mechanism of claim 28 further including means for rotating the cam means to either position with said bolt retracted into said housing.

30. The security lock mechanism of claim 28 further including detent means for releasably maintaining said cam means in a deadlocked position to secure said bolt extended from said housing.

31. The slam-lock mechanism of claim 27 further including detent means for releasably maintaining said rotatable cam means in a deadlocked position to secure said bolt extended from said housing.

32. The security lock mechanism of claim 25 further including detent means for releasably maintaining said rotatable cam means in a deadlocked position to secure said bolt extended from said housing.

33. The security lock mechanism of claim 25 wherein said bolt moves perpendicular to an axis of said rotatable cam means and further includes a slot in said bolt and a pin secured to said rotatable cam means and extending into said slot.

34. The security lock mechanism of claim 33 wherein the length and arrangement of the slot on said bolt are selected to permit the rotatable cam means to be rotated between deadlocked and slam-lock positions with said bolt substantially fully extended from said housing and to interact with the pin for retracting said bolt into said housing when the rotatable cam means is rotated to an open position.

35. The security lock mechanism of claim 34 wherein said pin has an overcenter position relative to the axis of the rotatable cam means and the longitudinal axis of said bolt when the rotatable cam means is in a deadlocked position to prevent retraction of said bolt.

36. The security lock mechanism of claim 35 further including detent means for releasably maintaining said rotatable cam means in a deadlocked position to secure said bolt extended from said housing.

37. The security lock mechanism of claim 25 wherein said powered means includes a lost motion coupling comprising a slot and pin interconnection between the rotatable cam means and said powered means.

38. The security lock mechanism of claim 37 wherein the slot has a length approximately equal to angular rotation of the rotatable cam means between its first and second positions.

39. The security lock mechanism of claim 25 wherein said powered means is remote and comprises double-acting drive means for moving the rotatable cam means between said positions with said bolt respectively extended from and retracted into said housing.

40. The security lock mechanism of claim 39 further comprising double-acting spring means releasably maintaining the rotatable cam means in its slam-lock position and deadlocked position at opposite operating limits of said lost motion coupling.

41. A security lock mechanism, comprising a lock housing, a locking bolt, (1) supported in said housing, (2) for extending through a bolt opening in said housing, (3) for extending to a locking position, and (4) moving through said housing to a retracted position;

guide means for aligning said bolt for linear movement through said opening between said locking and retracted positions;

rotatable cam means mounted adjacent to said bolt;

a locking surface on said cam means for securing said bolt in the locking position when said cam means is in a first position and wherein said cam means has a second position permitting movement of said bolt between positions;

detent means for releasably maintaining said rotatable cam means of a position securing said bolt in the extended position from the housing.

* * * * *